US012104364B2

(12) United States Patent
Zhu et al.

(10) Patent No.: US 12,104,364 B2
(45) Date of Patent: Oct. 1, 2024

(54) DRAIN PIPE STRUCTURE AND INSTALLATION METHOD THEREOF

(71) Applicant: Xiamen Lota International Co., Ltd., Fujian (CN)

(72) Inventors: Chuanbao Zhu, Fujian (CN); Yanyan Wang, Fujian (CN); Junqi Zhang, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 258 days.

(21) Appl. No.: 17/703,247

(22) Filed: Mar. 24, 2022

(65) Prior Publication Data

US 2023/0257978 A1 Aug. 17, 2023

(30) Foreign Application Priority Data

Feb. 17, 2022 (CN) ..... 202210147070.4

(51) Int. Cl.
*E03C 1/20* (2006.01)
*E03C 1/182* (2006.01)
*E03C 1/23* (2006.01)

(52) U.S. Cl.
CPC ..... *E03C 1/20* (2013.01); *E03C 1/182* (2013.01); *E03C 1/23* (2013.01)

(58) Field of Classification Search
CPC ... E03C 1/182; E03C 1/20; E03C 1/22; E03C 1/23; E03C 1/2302; E03C 1/2304; E03C 1/0401; E03C 1/0402
See application file for complete search history.

(56) References Cited

U.S. PATENT DOCUMENTS 4,807,306 A * 2/1989 Hayman ..... E03C 1/232 4/692
9,212,474 B2 * 12/2015 Ye ..... E03C 1/0401
11,208,791 B2 * 12/2021 Darocha ..... E03C 1/0401

* cited by examiner

*Primary Examiner* — Erin Deery
(74) *Attorney, Agent, or Firm* — Cooper Legal Group, LLC

(57) ABSTRACT

A drain pipe structure configured for a basin, comprising a drain pipe body for water drainage, at least one connecting seat, and at least one mounting seat. The at least one connecting seat is configured to be connected to the drain pipe body to be fixed relative to an axial direction of the drain pipe body and at least one of rotation direction about an axis of the drain pipe body. The at least one connecting seat comprises a first connecting member, and the at least one mounting seat comprises a second connecting member. The first connecting member is configured to be operatively coupled to the second connecting member to enable the at least one mounting seat to operatively move along the axial direction of the drain pipe body to be fixed to a predetermined position of the at least one connecting seat along the axial direction.

32 Claims, 14 Drawing Sheets

DRAIN PIPE STRUCTURE AND INSTALLATION METHOD THEREOF

RELATED APPLICATIONS

This application claims priority to Chinese patent application number 202210147070.4, filed on Feb. 17, 2022. Chinese patent application number 202210147070.4 is incorporated herein by reference.

FIELD OF THE DISCLOSURE

The present disclosure relates to a drain pipe structure and an installation method thereof.

BACKGROUND OF THE DISCLOSURE

Existing receptacles, such as bathroom tubs, washbasins, sinks, and the like conventionally comprise a drainer, also known as a drain pipe, and the drainer enables storage or drainage of water in the existing receptacles. The conventional drain pipe comprises an interlocking arrangement configured to drive a drain plug. For example, a receptacle is in communication with the conventional drain pipe through an outflow port, and the drain plug is disposed on the outflow port. One end of a lever is connected to the drain plug, and the other end of the lever is connected to a lift rod extending downwardly, so that the lift rod is pulled to enable the drain plug to alternatively move between an open position at which the outflow port is opened and a close position at which the outflow port is closed and to realize the storage or the drainage of water in the receptacle, such as a bathroom sink, tub, washbasin, and the like. In order to create an impression of high-end, the conventional drain pipe is generally made of all-metal. Most of the materials are copper or SUS (stainless steel), and a drain pipe body is made of machined threads and locked by mounting nuts to be locked to the receptacle.

BRIEF SUMMARY OF THE DISCLOSURE

The present disclosure provides a drain pipe structure and an installation method of the drain pipe structure to solve the deficiencies in the background.

In order to solve the technical problem, a first technical solution of the present disclosure is as follows.

A drain pipe structure configured for a basin, comprises a drain pipe body for water drainage, at least one connecting seat, and at least one mounting seat. The at least one connecting seat is configured to be connected to the drain pipe body to be fixed relative to an axial direction of the drain pipe body and at least one rotation direction about an axis of the drain pipe body. The at least one connecting seat comprises a first connecting member, and the at least one mounting seat comprises a second connecting member. The first connecting member is configured to be operatively coupled to the second connecting member to enable the at least one mounting seat to operatively move along the axial direction of the drain pipe body to be fixed to a predetermined position of the at least one connecting seat along the axial direction of the drain pipe body so that the at least one mounting seat is configured to cooperate with the drain pipe body to be clamped and fixed on the basin.

In a preferred embodiment, the at least one connecting seat is detachably connected to the drain pipe body.

In a preferred embodiment, the at least one connecting seat comprises at least one anti-rotation block, and the drain pipe body comprises at least one anti-rotation groove. The at least one connecting seat is configured to be connected to the drain pipe body from a lower end of the drain pipe body to move upward to an installation position to enable the at least one anti-rotation block to be correspondingly disposed in the at least one anti-rotation groove.

In a preferred embodiment, the at least one connecting seat comprises at least one anti-disconnection block. The at least one anti-disconnection block is elastically deformable, and the at least one mounting seat is configured to move along the axial direction of the drain pipe body to at least be alternatively at a loosening position and a pressing position. When the at least one mounting seat is changed from the loosening position to the pressing position, the at least one mounting seat abuts the at least one anti-disconnection block to drive the at least one anti-disconnection block to be connected to the drain pipe body.

In a preferred embodiment, the drain pipe body comprises an anti-disconnection groove for receiving the at least one anti-disconnection block In a preferred embodiment, the anti-disconnection groove is an annular groove located on the drain pipe body or at least one pressed groove on the drain pipe body.

In a preferred embodiment, the at least one connecting seat is sleeved outside of the drain pipe body, and the at least one mounting seat is sleeved outside of the at least one connecting seat. When a bottom end of the at least one mounting seat corresponds to a bottom end of the at least one connecting seat, the at least one mounting seat is at the loosening position. The at least one anti-disconnection block is located on an upper portion of the at least one connecting seat, and the at least one mounting seat is configured to move upward relative to the at least one connecting seat to press the at least one anti-disconnection block.

In a preferred embodiment, a receiving recess is defined on an outer side of the upper end of the at least one anti-rotation block. When the at least one connecting seat is at the installation position, the at least one anti-rotation groove is correspondingly engaged with the receiving recess.

In a preferred embodiment, the at least one connecting seat comprises at least one anti-rotation block, and the drain pipe body comprises at least one anti-rotation groove. The at least one connecting seat is configured to be connected to the drain pipe body from a lower end of the drain pipe body to move upward to an installation position so that the at least one anti-rotation block is correspondingly disposed in the at least one anti-rotation groove. The at least one anti-rotation block is elastically deformable. The at least one mounting seat is configured to move along the axial direction of the drain pipe body to at least be alternatively at a loosening position and a pressing position. When the at least one mounting seat is changed from the loosening position to the pressing position, the at least one mounting seat abuts the at least one anti-rotation block to drive the at least one anti-rotation block to be connected to the drain pipe body.

In a preferred embodiment, the at least one connecting seat comprises at least one lug, and the drain pipe body comprises an opening extending along the axial direction of the drain pipe body and an accommodating groove in communication with the opening and extending along a rotation direction about the axis of the drain pipe body. The at least one lug is configured to be disposed in the opening and move into the accommodating groove along the rotation direction about the axis of the drain pipe body.

In a preferred embodiment, one of the accommodating groove or the at least one lug comprises a protrusion, and the other one of the accommodating groove or the at least one lug comprises a recess. When the at least one lug is disposed in the accommodating groove, the protrusion is correspondingly disposed in the recess.

In a preferred embodiment, the drain pipe structure comprises at least one fastener. The at least one connecting seat is sleeved outside of the drain pipe body, and the at least one mounting seat is sleeved outside of the at least one connecting seat. The at least one connecting seat comprises at least one through hole, and the drain pipe body comprises at least one corresponding groove. The at least one connecting seat is configured to be connected to the drain pipe body from a lower end of the drain pipe body to move upward to an installation position to enable the at least one through hole to correspond to the at least one corresponding groove. The at least one fastener is configured to be disposed in the at least one through hole and the at least one corresponding groove to connect the at least one through hole and the at least one corresponding groove.

In a preferred embodiment, the at least one through hole is a plurality of through holes, and the plurality of through holes are evenly spaced along a circumferential direction of the at least one connecting seat. The at least one corresponding groove is a plurality of corresponding grooves, and the plurality of corresponding grooves are evenly spaced along the circumferential direction of the drain pipe body. The plurality of through holes are configured to respectively correspond to the plurality of corresponding grooves. The at least one fastener is a plurality of fasteners, and the plurality of fasteners are configured to respectively pass through the plurality of through holes and the plurality of corresponding grooves.

In a preferred embodiment, the at least one through hole is two through holes, the at least one corresponding groove is two corresponding grooves, the at least one fastener is a single fastener, and the single fastener is configured to pass through the two through holes and the two corresponding grooves.

In a preferred embodiment, the at least one connecting seat comprises at least one anti-disconnection block, the anti-disconnection block comprises a buckle structure, and the drain pipe body comprises a locking hole. When the at least one connecting seat is at the installation position, the buckle structure is disposed in the locking hole.

In a preferred embodiment, the at least one connecting seat comprises at least one anti-disconnection block, which is elastically deformable. The at least one mounting seat is configured to move along the axial direction of the drain pipe body to at least be alternatively at a loosening position and a pressing position, the at least one anti-disconnection block comprises an inner buckle, and the drain pipe body comprises a snap groove for receiving the inner buckle. When the at least one connecting seat is at the installation position, the inner buckle is snapped to the snap groove. When the at least one mounting seat is changed from the loosening position to the pressing position, the at least one mounting seat is moved to correspond to the at least one anti-disconnection block to inhibit outward deformation of the at least one anti-disconnection block along a radial direction of the drain pipe body.

In a preferred embodiment, the at least one connecting seat is integrally formed on the drain pipe body by overmolding.

In a preferred embodiment, the drain pipe body is made of metal. The drain pipe body comprises an upper pipe body located on an upper portion of the drain pipe body and a lower pipe body located on a lower portion of the drain pipe body. An upper end of the upper pipe body comprises an upper flange, and an upper end of the at least one mounting seat comprises a mounting flange. The at least one mounting seat is configured to adjustably move to enable the basin to be clamped and fixed between the upper flange and the mounting flange. The upper pipe body is configured to receive a control valve assembly configured to control a turning ON and OFF of water drainage of the drain pipe body, and an outer peripheral wall of the lower pipe body is configured to be connected with the at least one connecting seat.

In a preferred embodiment, the drain pipe structure comprises a sealing gasket, and the sealing gasket is configured to be disposed on an upper end of the at least one mounting seat.

In a preferred embodiment, the first connecting member and the second connecting member are connected by threads.

A second technical solution of the present disclosure is as follows.

An installation method of the drain pipe structure comprising:

- placing the drain pipe body passing through and disposed on an installation hole of the basin;
- connecting the at least one mounting seat to the at least one connecting seat, and making the at least one mounting seat be at the loosening position;
- connecting the at least one connecting seat to the drain pipe body from a lower end of the drain pipe body, and moving the at least one connecting seat upward to an installation position; and
- adjusting a position of the mounting seat on the at least one connecting seat to at least be at the pressing position to enable the at least one mounting seat to cooperate with the drain pipe body to be clamped and fixed on the basin.

Compared with the existing techniques, the technical solution has the following advantages.

The drain pipe structure configured for a basin, comprises the drain pipe body for the water drainage, the at least one connecting seat, and the at least one mounting seat. The at least one connecting seat is configured to be connected to the drain pipe body to be fixed relative to the axial direction of the drain pipe body and at least one of the rotation directions about the axis of the drain pipe body. The at least one connecting seat comprises the first connecting member, and the at least one mounting seat comprises the second connecting member. The first connecting member is configured to be operatively coupled to the second connecting member to enable the at least one mounting seat to operatively move along the axial direction of the drain pipe body to be fixed to the position of the at least one connecting seat along the axial direction of the drain pipe body so that the at least one mounting seat is configured to cooperate with the drain pipe body to be clamped and fixed on the basin. There is no need to directly machine the drain pipe body, which avoids the machining and saves the material cost.

DETAILED DESCRIPTION OF THE EMBODIMENTS

Figure 1:
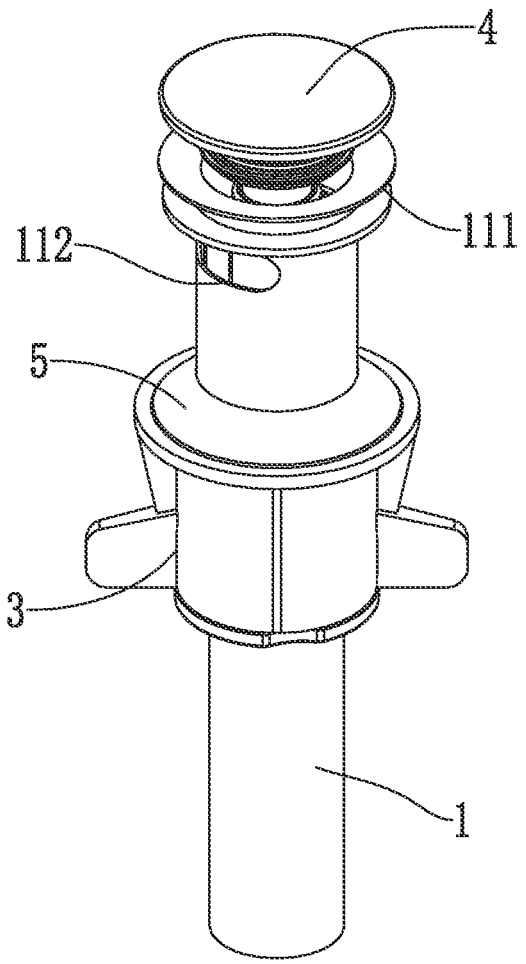
FIG. 1 illustrates a perspective view of a drain pipe structure in embodiment 1 of the present disclosure.
Figure 2:
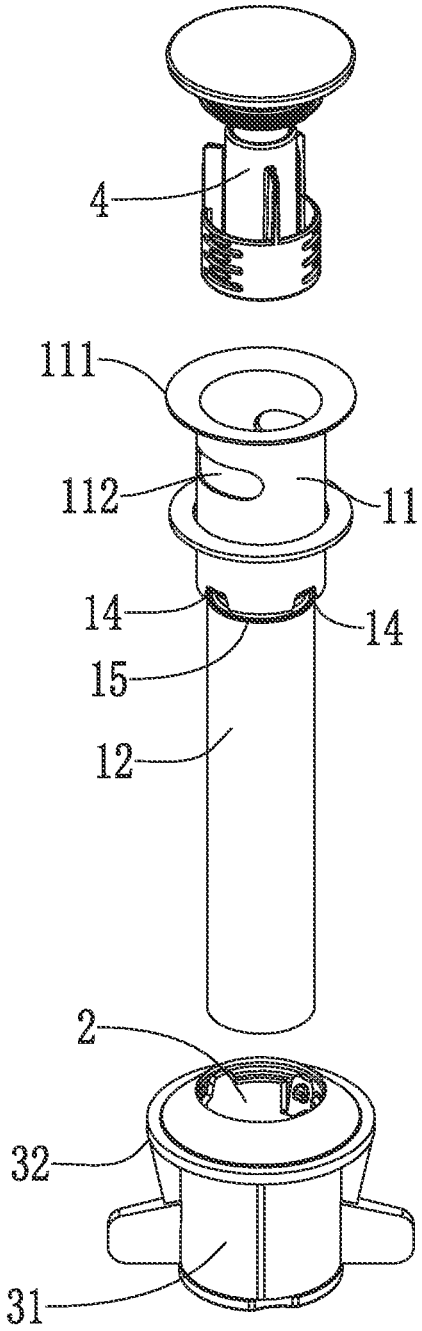
FIG. 2 illustrates an exploded view of the drain pipe structure in embodiment 1 of the present disclosure.
Figure 3:
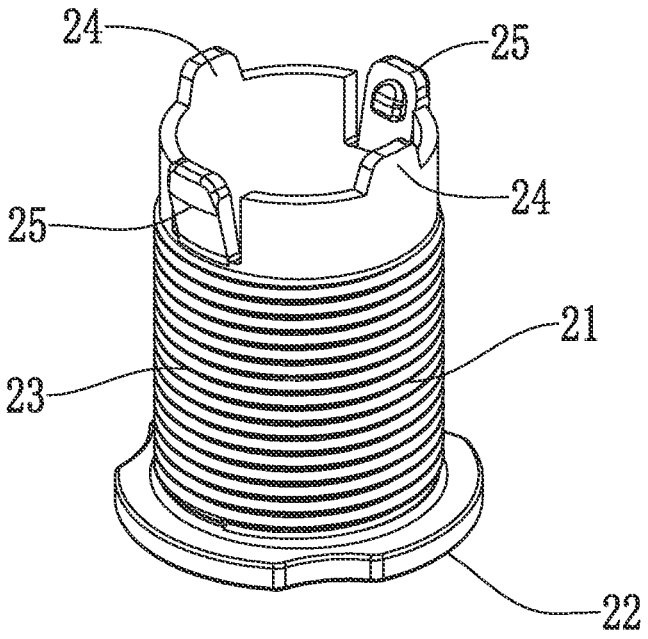
FIG. 3 illustrates a perspective view of at least one connecting seat in embodiment 1 of the present disclosure.
Figure 4:
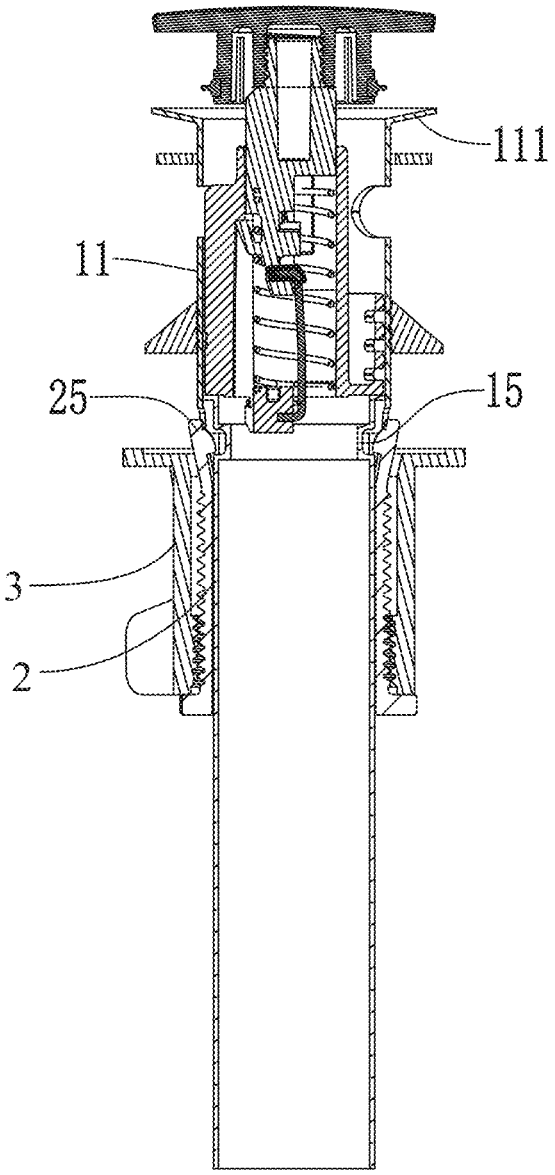
FIG. 4 illustrates a cross-sectional view of the drain pipe structure in embodiment 1 of the present disclosure when at least one mounting seat is at a loosening position.
Figure 5:
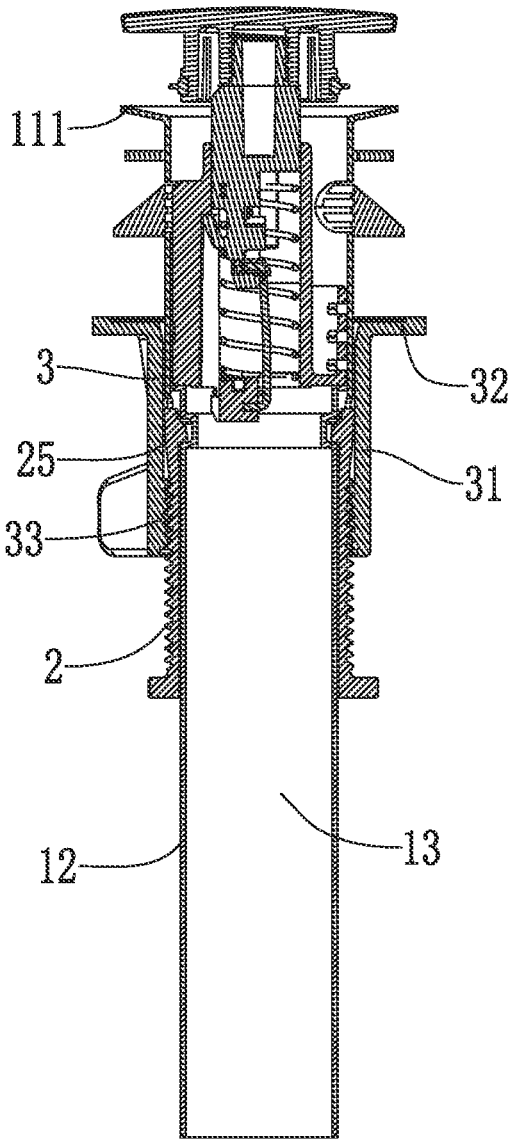
FIG. 5 illustrates a cross-sectional view of the drain pipe structure in embodiment 1 of the present disclosure when the at least one mounting seat is at a pressing position.

The present disclosure will be further described below in combination with the accompanying drawings and embodiments.

Some directional terms used to describe the drawings, such as "inner", "outer", "above", "below", and other directional terms will be understood to have their normal meaning and refer to those directions involved in normal viewing of the drawings. Unless otherwise indicated, directional terms described herein substantially follow conventional directions as understood by those skilled in the art. The terms "first", "second", and similar terms used in the present disclosure do not denote any order, quantity, or importance in the present disclosure, but are used to distinguish one component from other components.

Embodiment 1

Referring to FIGS. 1-5, a drain pipe structure is adapted for a basin, which can be a wash basin or other devices configured to be used as a water container, and the basin is not limited to the present disclosure. A bottom of the basin comprises an installation hole, and the installation hole is used for installing the drain pipe structure.

The drain pipe structure comprises a drain pipe body 1 for water drainage, at least one connecting seat 2, and at least one mounting seat 3. The drain pipe body 1 is made of metal, and more particularly the drain pipe body 1 is made of stainless steel. The drain pipe body 1 comprises an upper pipe body 11 located on an upper portion thereof and a lower pipe body 12 located on a lower portion thereof. The upper pipe body 11 and the lower pipe body 12 may be integrally formed or may be welded together, and processing methods thereof belong to the prior art and will not be repeated here. A diameter of the upper pipe body 11 is larger than a diameter of the lower pipe body 12, an axial dimension of the upper pipe body 11 is smaller than an axial dimension of the lower pipe body 12, and transverse sections of the upper pipe body 11 and the lower pipe body 12 are annular. In some simple alternatives, the transverse sections of the upper pipe body 11 and the lower pipe body 12 may be square or other shapes, and the shapes of the upper pipe body 11 and the lower pipe body 12 are not limited thereto.

An upper end of the upper pipe body 11 comprises an upper flange 111, and an outer peripheral wall of the upper pipe body 11 further comprises a receiving opening 112 configured to be in communication with a water level limiting flow channel of the basin. A drainage channel 13 for the water drainage is defined inside of the upper pipe body 11 and the lower pipe body 12. The receiving opening 112 is in communication with the drainage channel 13, and a lower end of the upper pipe body 11 extends inward to increase torsion resistance strength of the upper pipe body 11.

The upper pipe body 11 is configured to receive a control valve assembly 4 configured to control a turning ON and OFF of the drainage channel 13 of the drain pipe body 1. The control valve assembly 4 is a conventional pressing-and-bouncing valve assembly, and in some simple alternatives, the control valve assembly 4 may also be controlled through a mechanism such as a lift rod, which will not be described here in detail.

The at least one connecting seat 2 and the at least one mounting seat 3 are made of plastic. The at least one connecting seat 2 has the appearance of a revolving structure with a middle of which is removed. The at least one connecting seat 2 comprises a connecting pipe body 21 and a connecting base 22 located at a lower end of the connecting pipe body 21. The at least one connecting seat 2 is connected to the drain pipe body 1 to be fixed relative to an axial direction of the drain pipe body 1 and at least one rotation direction about an axis of the drain pipe body 1. The connection pipe body 21 of the at least one connecting seat 2 comprises a first connecting member 23. The at least one mounting seat 3 has the appearance of a revolving structure with a middle of which is removed. The at least one mounting seat 3 comprises a mounting pipe body 31 and a mounting flange 32 located at an upper end of the mounting pipe body 31. The drain pipe structure also comprises a gasket 5. The gasket 5 is configured to be disposed on the mounting flange 32, and the mounting pipe body 31 further comprises a second connecting member 33. In this embodiment, the first connecting member 23 and the second connecting member 33 are connected by threads. The first connecting member 23 is configured to be operatively coupled to the second connecting member 33 to enable the at least one mounting seat 3 to operatively move along the axial direction of the drain pipe body 1 to be fixed to a predetermined position of the at least one connecting seat 2 along the axial direction of the drain pipe body 1, so that the at least one mounting seat 3 is configured to cooperate with the drain pipe body 1 to be clamped and fixed on the basin. The predetermined position is determined according to a size and/or thickness of the basin.

The first connecting member 23 is formed on the at least one connecting seat 2 by machining. Therefore, there is no need to machine the drain pipe body 1. The at least one connecting seat 2 and the at least one mounting seat 3 can be made of materials other than metal. For example, when the at least one connecting seat 2 and the at least one mounting seat 3 are made of plastic, the first connecting member 23 and the second connecting member 33 are easy to machine, which avoids a need for machining the drain pipe body 1 and save the machining cost.

In this embodiment, the at least one connecting seat 2 is detachably connected to the drain pipe body 1. The at least one connecting seat 2 comprises at least one anti-rotation block 24, the drain pipe body 1 comprises at least one anti-rotation groove 14, and the at least one connecting seat 2 is configured to be connected to the drain pipe body 1 from a lower end of the drain pipe body 1 to move upward to an installation position to enable the at least one anti-rotation block 24 to be correspondingly inserted into the at least one anti-rotation groove 14. In this embodiment, the at least one anti-rotation block 24 is two anti-rotation blocks 24, and the two anti-rotation blocks 24 are arranged on an upper end surface of the connecting pipe body 21 at an interval of 180 degrees. The two anti-rotation blocks 24 are in a shape of an isosceles trapezoid. The at least one anti-rotation groove 14 is also in a shape of an isosceles trapezoid, and the at least one anti-rotation groove 14 is arranged at the lower end of the upper pipe body 11.

The at least one connecting seat 2 comprises at least one anti-disconnection block 25, and the at least one anti-disconnection block 25 is elastically deformable. The at least one mounting seat 3 is configured to move along the axial direction of the drain pipe body 1 to at least be alternatively at a loosening position and a pressing position. When the at least one mounting seat 3 is changed from the loosening position to the pressing position, the at least one mounting seat 3 abuts the at least one anti-disconnection block 25 to drive the at least one anti-disconnection block 25 to be connected to the drain pipe body 1. In this embodiment, the at least one anti-disconnection block 25 is two anti-disconnection blocks 25, and the two anti-disconnection blocks 25 are disposed on the upper end surface of the connecting pipe body 21 at an interval of 180 degrees. Each of the two anti-rotation blocks 24 is disposed between the two anti-disconnection blocks 25. A lower end of each of the two anti-disconnection blocks 25 is connected to the upper end surface of the connecting pipe body 21, and an upper end of each of the two anti-disconnection blocks 25 obliquely extends away from the connecting pipe body 21 along a radial direction of the drain pipe body 1. The at least one connecting seat 2 is sleeved outside of the drain pipe body 1, and the at least one mounting seat 3 is sleeved outside of the at least one connecting seat 2. When a bottom end of the at least one mounting seat 3 corresponds to a bottom end of the at least one connecting seat 2, the at least one mounting seat 3 is at the loosening position. Each of the two anti-disconnection blocks 25 is located on an upper portion of the at least one connecting seat 2, and the at least one mounting seat 3 is configured to move upward relative to the at least one connecting seat 2 to press each of the two anti-disconnection blocks 25.

In this embodiment, the drain pipe body 1 comprises an anti-disconnection groove 15 for receiving each of the two anti-disconnection blocks 25. The anti-disconnection groove 15 is an annular groove located on the drain pipe body 1 or at least one pressed groove on the drain pipe body 1.

During an installation process: (1) the drain pipe body 1 passes through and is disposed on the installation hole of the basin; the drain pipe body 1 passes through the installation hole from top to bottom to enable the upper flange 111 to abut a hole edge of the installation hole, so that the upper flange 111 can inhibit further downward movement of the drain pipe body 1; (2) the at least one mounting seat 3 is connected to the at least one connecting seat 2, and the at least one mounting seat 3 is moved to the loosening position; in this embodiment, the bottom end of the at least one mounting seat 3 correspondingly abuts the bottom end of the at least one connecting seat 2, and the at least one anti-disconnection block 25 protrudes from an upper end of the at least one mounting seat 3; (3) the at least one connecting seat 2 is connected to the drain pipe body 1 from the lower end of the drain pipe body 1 to move upward to the installation position; when the at least one connecting seat 2 is located at the installation position, the at least one anti-rotation block 24 is correspondingly inserted into the at least one anti-rotation groove 14; (4) a position of the at least one mounting seat 3 on the at least one connecting seat 2 is at least adjusted to the pressing position, and the at least one mounting seat 3 cooperates with the drain pipe body 1 to be clamped on the basin; in this embodiment, when the at least one mounting seat 3 moves upward, the at least one anti-disconnection block 25 is correspondingly pressed by an inner wall of the at least one mounting seat 3 to enable the at least one anti-disconnection block 25 to be correspondingly inserted into the anti-disconnection groove 15.

Embodiment 2

Figure 6:
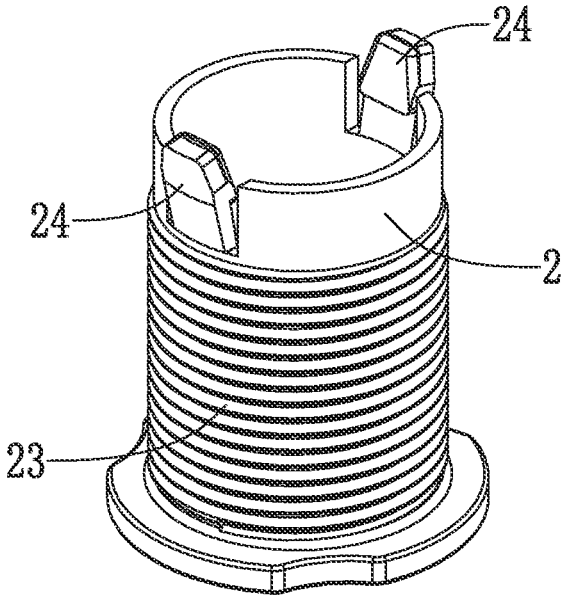
FIG. 6 illustrates a perspective view of at least one connecting seat in embodiment 2 of the present disclosure.

Referring to FIG. 6, embodiment 2 of the present disclosure is disclosed. The difference between this embodiment and embodiment 1 is a structure of the at least one anti-rotation block 24 and the at least one anti-disconnection block 25. The at least one anti-rotation block 24 incorporates a function of the at least one anti-disconnection block 25, as described below.

The at least one connecting seat 2 comprises at least one anti-rotation block 24, the drain pipe body 1 comprises at least one anti-rotation groove 14, and the at least one connecting seat 2 is configured to be connected to the drain pipe body 1 from the lower end of the drain pipe body 1 to move upward to the installation position, so that the at least one anti-rotation block 24 is correspondingly inserted into the at least one anti-rotation groove 14. The at least one anti-rotation block 24 is elastically deformable, and the at least one mounting seat 3 is configured to move along the axial direction of the drain pipe body 1 to at least be alternatively at a loosening position and a pressing position. When the at least one mounting seat 3 is changed from the loosening position to the pressing position, the at least one mounting seat 3 abuts the at least one anti-rotation block 24 to drive the at least one anti-rotation block 24 to be connected to the drain pipe body 1. A lower end of the at least one anti-rotation block 24 is connected to the upper end surface of the connecting pipe body 21, and an upper end of the at least one anti-rotation block 24 extends obliquely away from the connecting pipe body 21 along the radial direction of the drain pipe body 1.

In this embodiment, the at least one anti-rotation block 24 is two anti-rotation blocks 24. The two anti-rotation blocks 24 are disposed on the upper end surface of the connecting pipe body 21 at an interval of 180 degrees, and the two anti-rotation blocks 24 are in a shape of an isosceles trapezoid. The at least one anti-rotation groove 14 is also in a shape of an isosceles trapezoid, and the at least one anti-rotation groove 14 is arranged at the lower end of the upper pipe body 11.

During the installation process: (1) the drain pipe body 1 passes through and is disposed on the installation hole of the basin; the drain pipe body 1 passes through the installation hole from top to bottom to enable the upper flange 111 to abut the hole edge of the installation hole, so that the upper flange 111 can inhibit the further downward movement of the drain pipe body 1; (2) the at least one mounting seat 3 is connected to the at least one connecting seat 2, and the at least one mounting seat 3 is moved to the loosening position; in this embodiment, the bottom end of the at least one mounting seat 3 correspondingly abuts the bottom end of the at least one connecting seat 2, and the at least one anti-rotation block 24 protrudes from an upper end of the at least one mounting seat 3; (3) the at least one connecting seat 2 is connected to the drain pipe body 1 from the lower end of the drain pipe body 1 to move upward to the installation position; when the at least one connecting seat 2 is located at the installation position, the at least one anti-rotation block 24 is correspondingly inserted into the at least one anti-rotation groove 14; (4) the position of the at least one mounting seat 3 on the at least one connecting seat 2 is at least adjusted to the pressing position, and the at least one mounting seat 3 cooperates with the drain pipe body 1 to be clamped on the basin; in this embodiment, when the at least one mounting seat 3 moves upward, the at least one anti-rotation block 24 is correspondingly pressed by the inner wall of the at least one mounting seat 3 to enable the at least one anti-rotation block 24 to be correspondingly inserted into the anti-disconnection groove 15. The anti-disconnection groove 15 of this embodiment is similar to the anti-disconnection groove 15 of embodiment 1, and the anti-disconnection groove 15 can be the annular groove or a plurality of pressing grooves.

Embodiment 3

Figure 7:
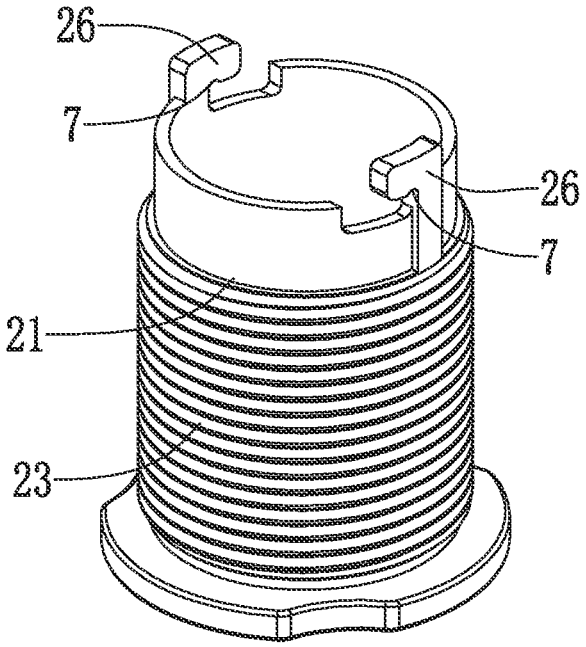
FIG. 7 illustrates a perspective view of at least one connecting seat in embodiment 3 of the present disclosure.
Figure 8:
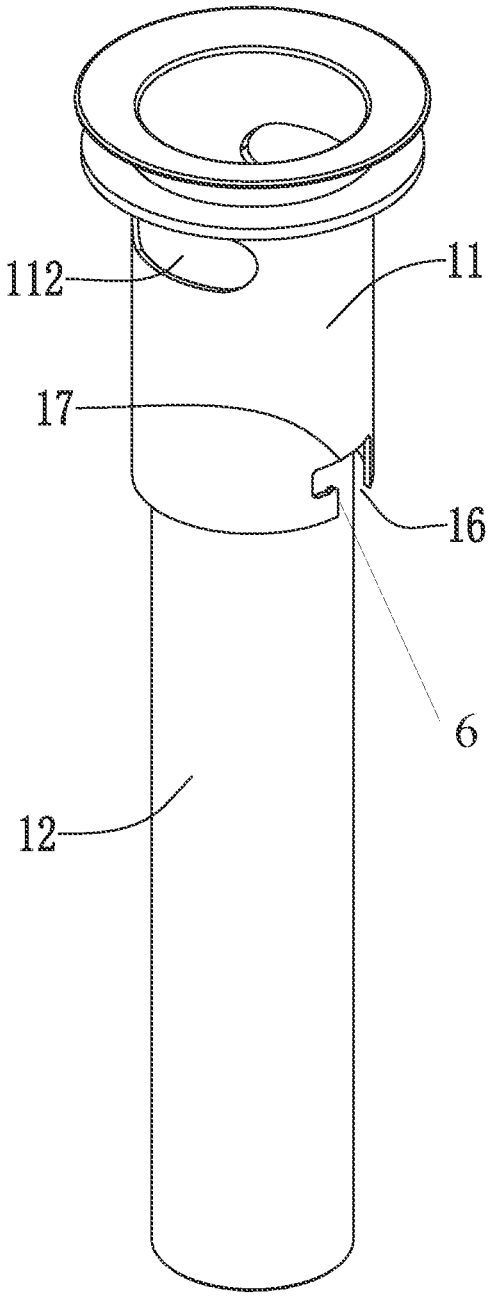
FIG. 8 illustrates a perspective view of a drain pipe body in embodiment 3 of the present disclosure.

Referring to FIGS. 7-8, embodiment 3 of the present disclosure is disclosed. The difference between this embodiment and embodiment 1 is that embodiment 3 dispenses with the at least one anti-disconnection block 25 and the at least one anti-rotation block 24. The at least one connecting seat 2 comprises at least one lug 26, and the drain pipe body 1 comprises an opening 16 extending along the axial direction thereof and an accommodating groove 17 in communication with the opening 16 and extending along a rotation direction of the rotation directions about the axis of the drain pipe body 1. The at least one lug 26 is snapped into the opening 16 and moves into the accommodating groove 17 along the rotation direction of the rotation directions about the axis of the drain pipe body 1.

In this embodiment, the at least one lug 26 is two lugs 26 disposed at an interval of 180 degrees along a circumferential direction of the at least one connecting seat 2, and the two lugs 26 are disposed on the upper end of the at least one connecting seat 2. One of the accommodating groove 17 or the at least one lug 26 comprises a protrusion 6, and the other one of the accommodating groove 17 or the at least one lug 26 comprises a recess 7. When the at least one lug 26 is snapped into the accommodating groove 17, the protrusion 6 is correspondingly inserted into the recess 7.

During the installation process: (1) the drain pipe body 1 passes through and is disposed on the installation hole of the basin; the drain pipe body 1 passes through the installation hole from top to bottom to enable the upper flange 111 to abut the hole edge of the installation hole, so that the upper flange 111 can inhibit the further downward movement of the drain pipe body 1; (2) the at least one mounting seat 3 is connected to the at least one connecting seat 2; in this embodiment, the bottom end of the at least one mounting seat 3 correspondingly abuts the bottom end of the at least one connecting seat 2; (3) the at least one connecting seat 2 is connected to the drain pipe body 1 from the lower end of the drain pipe body 1 to move upward to enable the at least one lug 26 to be correspondingly connected to the accommodating groove 17; the protrusion 6 is correspondingly inserted into the recess 7; (4) the position of the at least one mounting seat 3 on the at least one connecting seat 2 is at least adjusted to the pressing position, and the at least one mounting seat 3 cooperates with the drain pipe body 1 to be clamped on the basin.

Embodiment 4

Figure 9:
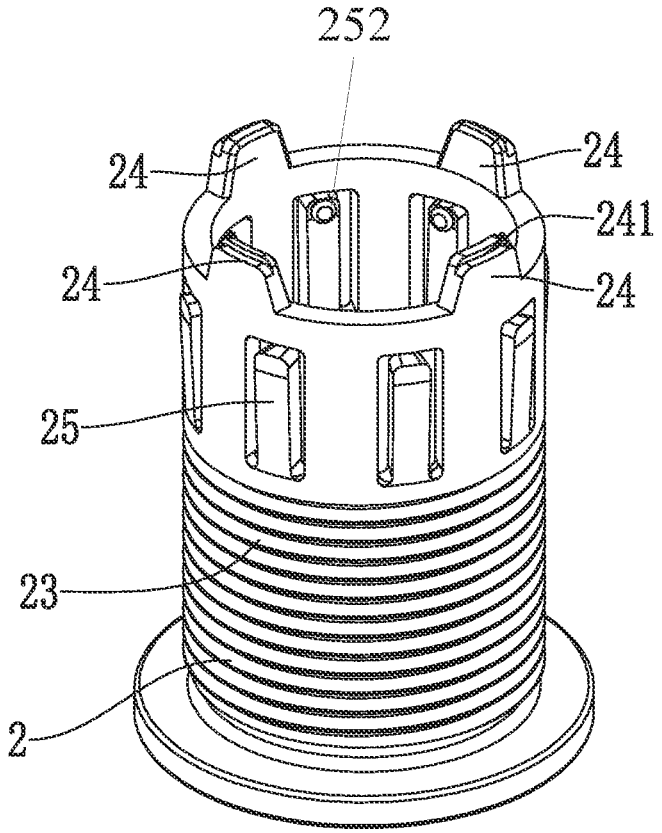
FIG. 9 illustrates a perspective view of at least one connecting seat in embodiment 4 of the present disclosure.

Referring to FIG. 9, embodiment 4 of the present disclosure is disclosed. The difference between this embodiment and embodiment 1 is in the arrangement of the at least one anti-disconnection block 25 and the at least one anti-rotation block 24.

In this embodiment, the at least one anti-rotation block 24 is four anti-rotation blocks 24 arranged at even intervals along a circumferential direction of the at least one connecting seat 2, and the four anti-rotation blocks 24 are all disposed on the upper end of the at least one connecting seat 2. The at least one anti-disconnection block 25 is disposed on a pipe wall of the connecting pipe body 21. The lower end of the at least one anti-disconnection block 25 is connected to the pipe wall of the connecting pipe body 21, and the upper end of the at least one anti-disconnection block 25 extends upward. An inner side of the upper end of the at least one anti-disconnection block 25 also comprises a pressing block 252.

A receiving recess 241 is defined on an outer side of the upper end of the at least one anti-rotation block 24. When the at least one connecting seat 2 is at the installation position, the at least one anti-rotation groove 14 is correspondingly engaged with the receiving recess 241.

The installation process of this embodiment is similar to that of embodiment 1, and the difference is that the pressing block 252 is directly pressed against an outer wall of the lower pipe body 12.

Embodiment 5

Figure 10:
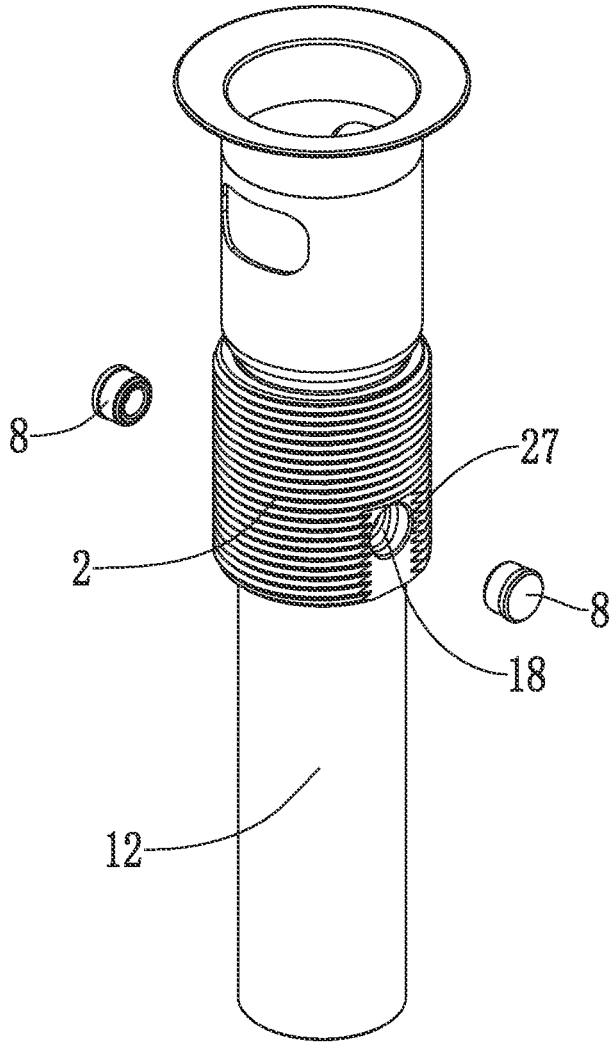
FIG. 10 illustrates an exploded view of a drain pipe body, at least one connecting seat, and at least one fastener in embodiment 5 of the present disclosure.

Referring to FIG. 10, embodiment 5 of the present disclosure is disclosed. The difference between this embodiment and embodiment 1 is that this embodiment dispenses with the at least one anti-disconnection block 25 and the at least one anti-rotation block 24. The at least one connecting seat 2 is sleeved outside of the drain pipe body 1, and the at least one mounting seat 3 is sleeved outside of the at least one connecting seat 2. The at least one connecting seat 2 comprises at least one through hole 27, and the drain pipe body 1 comprises at least one corresponding groove 18. The at least one connecting seat 2 is configured to be connected to the drain pipe body 1 from the lower end of the drain pipe body 1 to move upward to the installation position to enable the at least one through hole 27 to correspond to the at least one corresponding groove 18. The drain pipe structure further comprises at least one fastener 8, and the at least one fastener 8 is configured to be disposed in the at least one through hole 27 and the at least one corresponding groove 18 to connect the at least one through hole 27 and the at least one corresponding groove 18.

In this embodiment, the at least one through hole 27 is a plurality of through holes 27, and the plurality of through holes 27 are evenly spaced along the circumferential direction of the at least one connecting seat 2. The at least one corresponding groove 18 is a plurality of corresponding grooves 18, and the plurality of corresponding grooves 18 are evenly spaced along a circumferential direction of the drain pipe body 1. The plurality of through holes 27 are configured to respectively correspond to the plurality of corresponding grooves 18. The at least one fastener 8 is a plurality of fasteners 8, and the plurality of fasteners 8 respectively pass through the plurality of through holes 27 and the plurality of corresponding grooves 18.

In this embodiment, the plurality of through holes 27 are two through holes 27, the plurality of corresponding grooves 18 are two corresponding grooves 18 that are blind holes, and the plurality of fasteners 8 are plastic plugs or anchors.

During the installation process, only the at least one connecting seat 2 needs to be sleeved on the lower pipe body 12 and the at least one through hole 27 needs to correspond to the at least one corresponding groove 18, and the at least one fastener 8 can be inserted into the at least one connecting seat 2 and the lower pipe body 12. The rest of the installation process will not be repeated here.

Embodiment 6

Figure 11:
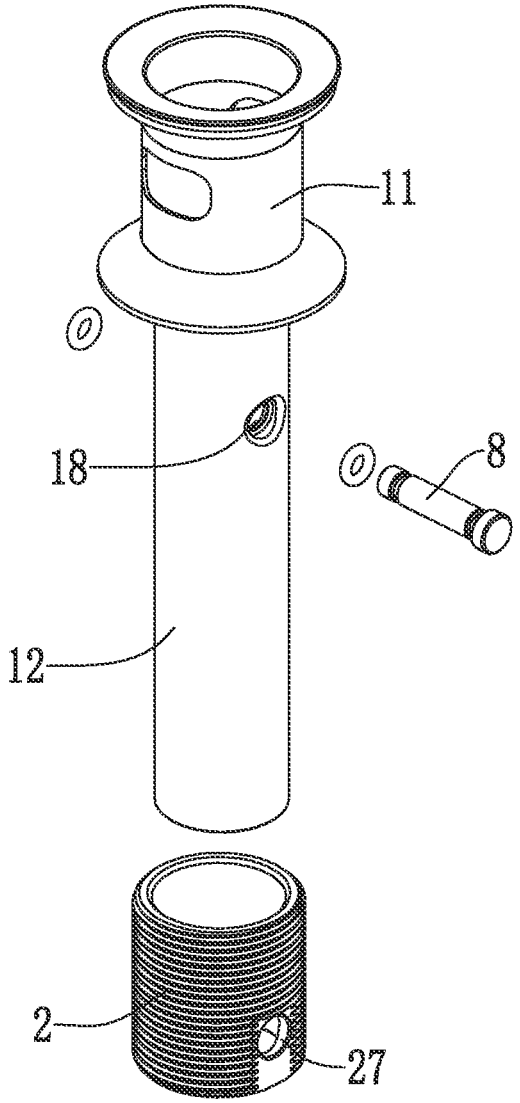
FIG. 11 illustrates an exploded view of a drain pipe body, at least one connecting seat, and a fastener in embodiment 6 of the present disclosure.

Referring to FIG. 11, embodiment 6 of the present disclosure is disclosed. The difference between this embodiment and embodiment 5 is that the at least one connecting seat 2 comprises two through holes 27, and the drain pipe body 1 comprises two corresponding grooves 18. The drain pipe structure comprises a fastener 8, and the fastener 8 passes through the two through holes 27 and the two corresponding grooves 18. The two corresponding grooves 18 are through holes, and the fastener 8 is a pin. The fastener 8 passes through and connects the two through holes 27 and the two corresponding grooves 18.

Embodiment 7

Figure 12:
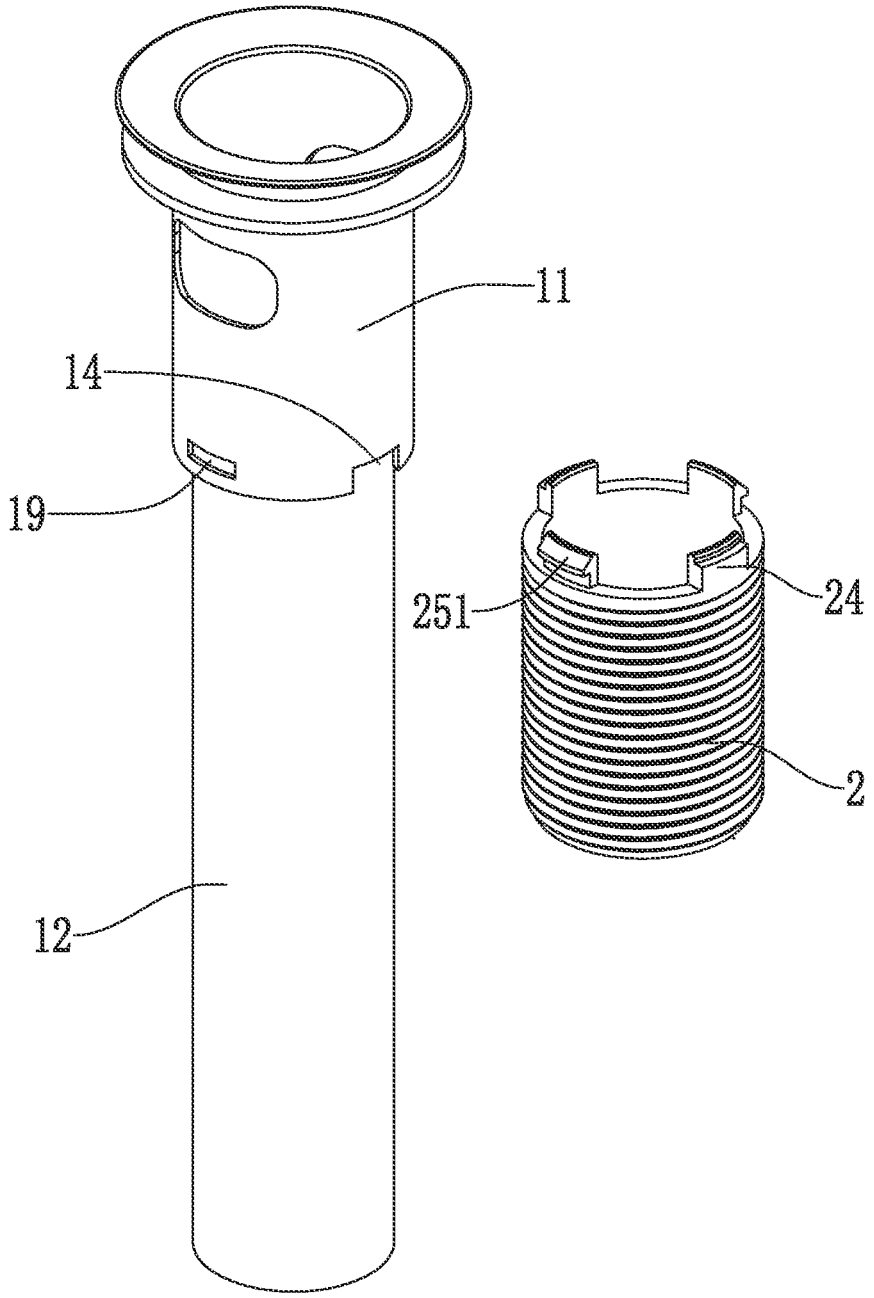
FIG. 12 illustrates an exploded view of a drain pipe body and at least one connecting seat in embodiment 7 of the present disclosure.

Referring to FIG. 12, embodiment 7 of the present disclosure is disclosed. The difference between this embodiment and embodiment 1 is that the structure of the at least one anti-disconnection block 25 is different from that of embodiment 1. The at least one anti-disconnection block 25 comprises a buckle structure 251, and the drain pipe body 1 also comprises a locking hole 19. When the at least one connecting seat 2 is at the installation position, the buckle structure 251 is snap-connected to the locking hole 19.

In this embodiment, the at least one connecting seat 2 comprises two anti-rotation blocks 24 and two anti-disconnection blocks 25, and the two anti-rotation blocks 24 and the two anti-disconnection blocks 25 are both disposed on the upper end of the at least one connecting seat 2.

Embodiment 8

Figure 13:
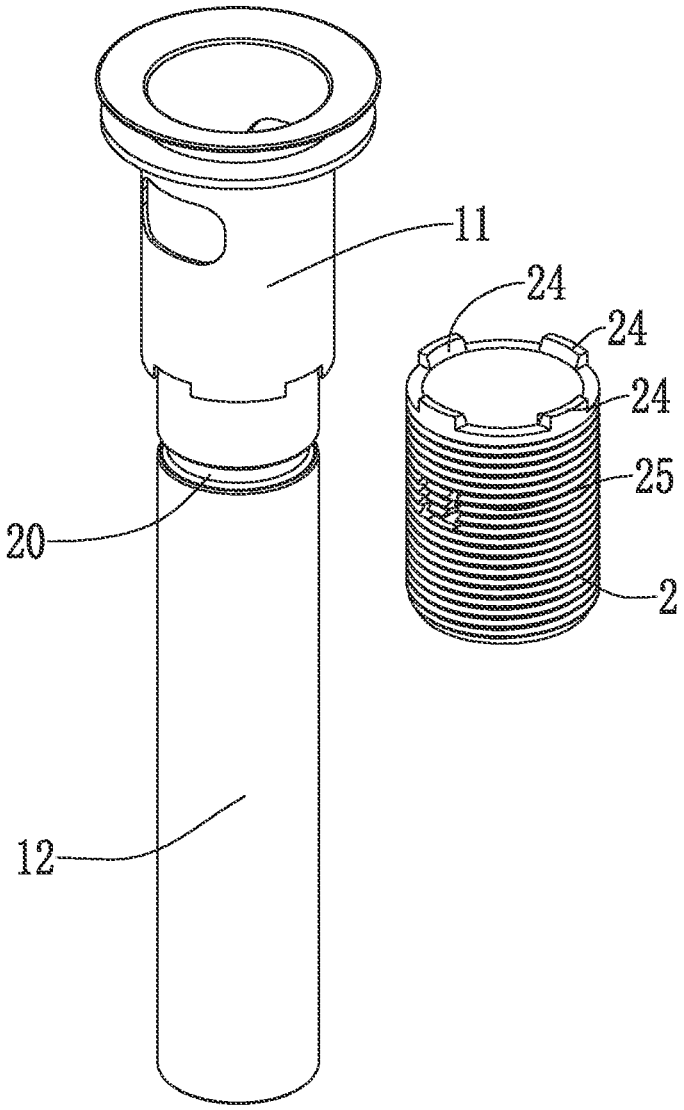
FIG. 13 illustrates an exploded view of a drain pipe body and at least one connecting seat in embodiment 8 of the present disclosure.

Referring to FIG. 13, embodiment 8 of the present disclosure is disclosed. The difference between this embodiment and embodiment 1 is that the at least one connecting seat 2 comprises at least one anti-disconnection block 25, which is elastically deformable. The at least one mounting seat 3 is configured to move along the axial direction of the drain pipe body 1 to at least be alternatively at a loosening position and a pressing position. The at least one anti-disconnection block 25 comprises an inner buckle, and the drain pipe body 1 comprises a snap groove 20 for receiving the inner buckle. When the at least one connecting seat 2 is at the installation position, the inner buckle is snapped to the snap groove 20. When the at least one mounting seat 3 is changed from the loosening position to the pressing position, the at least one mounting seat 3 is moved to correspond to the at least one anti-disconnection block 25 to inhibit outward deformation of the at least one anti-disconnection block 25 that is along the radial direction of the drain pipe body 1.

Embodiment 9

Figure 14:
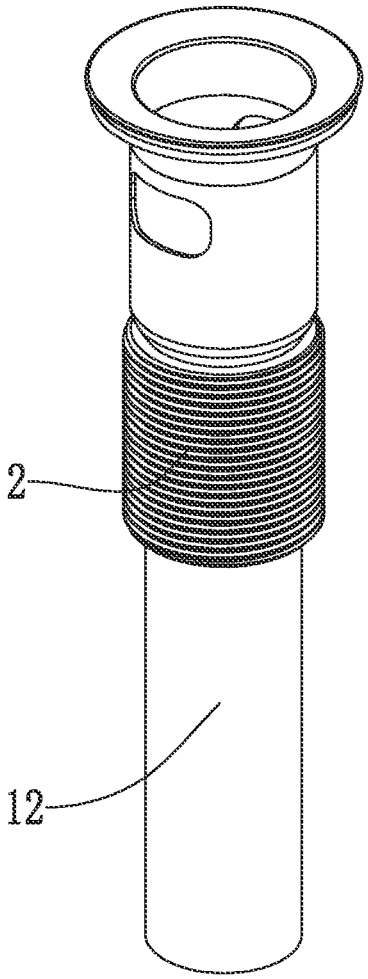
FIG. 14 illustrates a perspective view of a drain pipe body and at least one connecting seat in embodiment 9 of the present disclosure.

Referring to FIG. 14, embodiment 9 of the present disclosure is disclosed. The difference between this embodiment and embodiment 1 is that the at least one connecting seat 2 is integrally formed on the drain pipe body 1 by overmolding.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A drain pipe structure configured for a basin, comprising:

a drain pipe body for water drainage, at least one connecting seat, and at least one mounting seat, wherein:

the at least one connecting seat is configured to be connected to the drain pipe body to be fixed relative to an axial direction of the drain pipe body and at least one rotation direction about an axis of the drain pipe body, the at least one connecting seat comprises a first connecting member, the at least one mounting seat comprises a second connecting member, and the first connecting member is configured to be operatively coupled to the second connecting member to enable the at least one mounting seat to operatively move along the axial direction of the drain pipe body to be fixed to a predetermined position of the at least one connecting seat along the axial direction of the drain pipe body so that the at least one mounting seat is configured to cooperate with the drain pipe body to be clamped and fixed on the basin.

2. The drain pipe structure according to claim 1, wherein:

the at least one connecting seat is detachably connected to the drain pipe body.

3. The drain pipe structure according to claim 2, wherein:

the at least one connecting seat comprises at least one anti-rotation block, the drain pipe body comprises at least one anti-rotation groove, and the at least one connecting seat is configured to be connected to the drain pipe body from a lower end of the drain pipe body to move upward to an installation position to enable the at least one anti-rotation block to be correspondingly disposed in the at least one anti-rotation groove.

4. The drain pipe structure according to claim 3, wherein:

a receiving recess is defined on an outer side of an upper end of the at least one anti-rotation block, and when the at least one connecting seat is at the installation position, the at least one anti-rotation groove is correspondingly engaged with the receiving recess.

5. The drain pipe structure according to claim 4, wherein:

the at least one connecting seat comprises at least one anti-disconnection block, the anti-disconnection block comprises a buckle structure, the drain pipe body comprises a locking hole, and when the at least one connecting seat is at the installation position, the buckle structure is disposed in the locking hole.

6. The drain pipe structure according to claim 4, wherein:

the at least one connecting seat comprises at least one anti-disconnection block, which is elastically deformable, the at least one mounting seat is configured to move along the axial direction of the drain pipe body to at least be alternatively at a loosening position and a pressing position, the at least one anti-disconnection block comprises an inner buckle, the drain pipe body comprises a snap groove for receiving the inner buckle, when the at least one connecting seat is at the installation position, the inner buckle is snapped to the snap groove, and when the at least one mounting seat is changed from the loosening position to the pressing position, the at least one mounting seat is moved to correspond to the at least one anti-disconnection block to inhibit outward deformation of the at least one anti-disconnection block along a radial direction of the drain pipe body.

7. The drain pipe structure according to claim 3, wherein:

the at least one connecting seat comprises at least one anti-disconnection block, the anti-disconnection block comprises a buckle structure, the drain pipe body comprises a locking hole, and when the at least one connecting seat is at the installation position, the buckle structure is disposed in the locking hole.

8. The drain pipe structure according to claim 3, wherein:

the at least one connecting seat comprises at least one anti-disconnection block, which is elastically deformable, the at least one mounting seat is configured to move along the axial direction of the drain pipe body to at least be alternatively at a loosening position and a pressing position, the at least one anti-disconnection block comprises an inner buckle, the drain pipe body comprises a snap groove for receiving the inner buckle, when the at least one connecting seat is at the installation position, the inner buckle is snapped to the snap groove, and when the at least one mounting seat is changed from the loosening position to the pressing position, the at least one mounting seat is moved to correspond to the at least one anti-disconnection block to inhibit outward deformation of the at least one anti-disconnection block along a radial direction of the drain pipe body.

9. An installation method of the drain pipe structure according to claim 8, comprising:

placing the drain pipe body to pass through and be disposed on an installation hole of the basin;

connecting the at least one mounting seat to the at least one connecting seat, and making the at least one mounting seat be at the loosening position;

connecting the at least one connecting seat to the drain pipe body from a lower end of the drain pipe body, and moving the at least one connecting seat upward to an installation position; and adjusting a position of the at least one mounting seat on the at least one connecting seat to at least be at the pressing position to enable the at least one mounting seat to cooperate with the drain pipe body to be clamped and fixed on the basin.

10. The drain pipe structure according to claim 3, wherein:

the at least one connecting seat comprises at least one anti-disconnection block, the at least one anti-disconnection block is elastically deformable, the at least one mounting seat is configured to move along the axial direction of the drain pipe body to at least be alternatively at a loosening position and a pressing position, and when the at least one mounting seat is changed from the loosening position to the pressing position, the at least one mounting seat abuts the at least one anti-disconnection block to drive the at least one anti-disconnection block to be connected to the drain pipe body.

11. The drain pipe structure according to claim 10, wherein:

the drain pipe body comprises an anti-disconnection groove for receiving the at least one anti-disconnection block.

12. The drain pipe structure according to claim 11, wherein:

the anti-disconnection groove is an annular groove located on the drain pipe body or at least one pressed groove on the drain pipe body.

13. The drain pipe structure according to claim 10, wherein:

the at least one connecting seat is sleeved outside of the drain pipe body, the at least one mounting seat is sleeved outside of the at least one connecting seat, when a bottom end of the at least one mounting seat corresponds to a bottom end of the at least one connecting seat, the at least one mounting seat is at the loosening position, the at least one anti-disconnection block is located on an upper portion of the at least one connecting seat, and the at least one mounting seat is configured to move upward relative to the at least one connecting seat to press the at least one anti-disconnection block.

14. The drain pipe structure according to claim 2, wherein:

the at least one connecting seat comprises at least one anti-rotation block, the drain pipe body comprises at least one anti-rotation groove, the at least one connecting seat is configured to be connected to the drain pipe body from a lower end of the drain pipe body to move upward to an installation position so that the at least one anti-rotation block is correspondingly disposed in the at least one anti-rotation groove, the at least one anti-rotation block is elastically deformable, the at least one mounting seat is configured to move along the axial direction of the drain pipe body to at least be alternatively at a loosening position and a pressing position, and when the at least one mounting seat is changed from the loosening position to the pressing position, the at least one mounting seat abuts the at least one anti-rotation block to drive the at least one anti-rotation block to be connected to the drain pipe body.

15. An installation method of the drain pipe structure according to claim 14, comprising:

placing the drain pipe body to pass through and be disposed on an installation hole of the basin;

connecting the at least one mounting seat to the at least one connecting seat, and making the at least one mounting seat be at the loosening position;

connecting the at least one connecting seat to the drain pipe body from a lower end of the drain pipe body, and moving the at least one connecting seat upward to an installation position; and adjusting a position of the at least one mounting seat on the at least one connecting seat to at least be at the pressing position to enable the at least one mounting seat to cooperate with the drain pipe body to be clamped and fixed on the basin.

16. The drain pipe structure according to claim 2, wherein:

the at least one connecting seat comprises at least one lug, the drain pipe body comprises an opening extending along the axial direction of the drain pipe body and an accommodating groove in communication with the opening and extending along a rotation direction about the axis of the drain pipe body, and the at least one lug is configured to be disposed in the opening and move into the accommodating groove along the rotation direction about the axis of the drain pipe body.

17. The drain pipe structure according to claim 16, wherein:

one of the accommodating groove or the at least one lug comprises a protrusion, the other one of the accommodating groove or the at least one lug comprises a recess, and when the at least one lug is disposed in the accommodating groove, the protrusion is correspondingly disposed in the recess.

18. The drain pipe structure according to claim 2, comprising:

at least one fastener, wherein:

the at least one connecting seat is sleeved outside of the drain pipe body, the at least one mounting seat is sleeved outside of the at least one connecting seat, the at least one connecting seat comprises at least one through hole, the drain pipe body comprises at least one corresponding groove, the at least one connecting seat is configured to be connected to the drain pipe body from a lower end of the drain pipe body to move upward to an installation position to enable the at least one through hole to correspond to the at least one corresponding groove, and the at least one fastener is configured to be disposed in the at least one through hole and the at least one corresponding groove to connect the at least one through hole and the at least one corresponding groove.

19. The drain pipe structure according to claim 18, wherein:

the at least one through hole is a plurality of through holes, the plurality of through holes are evenly spaced along a circumferential direction of the at least one connecting seat, the at least one corresponding groove is a plurality of corresponding grooves, the plurality of corresponding grooves are evenly spaced along the circumferential direction of the drain pipe body, the plurality of through holes are configured to respectively correspond to the plurality of corresponding grooves, the at least one fastener is a plurality of fasteners, and the plurality of fasteners are configured to respectively pass through the plurality of through holes and the plurality of corresponding grooves.

20. The drain pipe structure according to claim 18, wherein:

the at least one through hole is two through holes, the at least one corresponding groove is two corresponding grooves, the at least one fastener is a single fastener, and the single fastener is configured to pass through the two through holes and the two corresponding grooves.

21. The drain pipe structure according to claim 1, wherein:

the at least one connecting seat comprises at least one anti-disconnection block, the at least one anti-disconnection block is elastically deformable, the at least one mounting seat is configured to move along the axial direction of the drain pipe body to at least be alternatively at a loosening position and a pressing position, and when the at least one mounting seat is changed from the loosening position to the pressing position, the at least one mounting seat abuts the at least one anti-disconnection block to drive the at least one anti-disconnection block to be connected to the drain pipe body.

22. The drain pipe structure according to claim 21, wherein:

the drain pipe body comprises an anti-disconnection groove for receiving the at least one anti-disconnection block.

23. The drain pipe structure according to claim 22, wherein:

the anti-disconnection groove is an annular groove located on the drain pipe body or at least one pressed groove on the drain pipe body.

24. An installation method of the drain pipe structure according to claim 23, comprising:

placing the drain pipe body to pass through and be disposed on an installation hole of the basin;

connecting the at least one mounting seat to the at least one connecting seat, and making the at least one mounting seat be at the loosening position;

connecting the at least one connecting seat to the drain pipe body from a lower end of the drain pipe body, and moving the at least one connecting seat upward to an installation position; and adjusting a position of the at least one mounting seat on the at least one connecting seat to at least be at the pressing position to enable the at least one mounting seat to cooperate with the drain pipe body to be clamped and fixed on the basin.

25. An installation method of the drain pipe structure according to claim 22, comprising:

placing the drain pipe body to pass through and be disposed on an installation hole of the basin;

connecting the at least one mounting seat to the at least one connecting seat, and making the at least one mounting seat be at the loosening position;

connecting the at least one connecting seat to the drain pipe body from a lower end of the drain pipe body, and moving the at least one connecting seat upward to an installation position; and adjusting a position of the at least one mounting seat on the at least one connecting seat to at least be at the pressing position to enable the at least one mounting seat to cooperate with the drain pipe body to be clamped and fixed on the basin.

26. The drain pipe structure according to claim 21, wherein:

the at least one connecting seat is sleeved outside of the drain pipe body, the at least one mounting seat is sleeved outside of the at least one connecting seat, when a bottom end of the at least one mounting seat corresponds to a bottom end of the at least one connecting seat, the at least one mounting seat is at the loosening position, the at least one anti-disconnection block is located on an upper portion of the at least one connecting seat, and the at least one mounting seat is configured to move upward relative to the at least one connecting seat to press the at least one anti-disconnection block.

27. An installation method of the drain pipe structure according to claim 26, comprising:

placing the drain pipe body to pass through and be disposed on an installation hole of the basin;

connecting the at least one mounting seat to the at least one connecting seat, and making the at least one mounting seat be at the loosening position;

connecting the at least one connecting seat to the drain pipe body from a lower end of the drain pipe body, and moving the at least one connecting seat upward to an installation position; and adjusting a position of the at least one mounting seat on the at least one connecting seat to at least be at the pressing position to enable the at least one mounting seat to cooperate with the drain pipe body to be clamped and fixed on the basin.

28. An installation method of the drain pipe structure according to claim 21, comprising:

placing the drain pipe body to pass through and be disposed on an installation hole of the basin;

connecting the at least one mounting seat to the at least one connecting seat, and making the at least one mounting seat be at the loosening position;

connecting the at least one connecting seat to the drain pipe body from a lower end of the drain pipe body, and moving the at least one connecting seat upward to an installation position; and adjusting a position of the at least one mounting seat on the at least one connecting seat to at least be at the pressing position to enable the at least one mounting seat to cooperate with the drain pipe body to be clamped and fixed on the basin.

29. The drain pipe structure according to claim 1, wherein:

the at least one connecting seat is integrally formed on the drain pipe body by overmolding.

30. The drain pipe structure according to claim 1, wherein:

the drain pipe body is made of metal, the drain pipe body comprises an upper pipe body located on an upper portion of the drain pipe body and a lower pipe body located on a lower portion of the drain pipe body, an upper end of the upper pipe body comprises an upper flange, an upper end of the at least one mounting seat comprises a mounting flange, the at least one mounting seat is configured to adjustably move to enable the basin to be clamped and fixed between the upper flange and the mounting flange, the upper pipe body is configured to receive a control valve assembly configured to control a turning ON and OFF of water drainage of the drain pipe body, and an outer peripheral wall of the lower pipe body is configured to be connected with the at least one connecting seat.

31. The drain pipe structure according to claim 1, comprising:

a sealing gasket, wherein:

the sealing gasket is configured to be disposed on an upper end of the at least one mounting seat.

32. The drain pipe structure according to claim 1, wherein:

the first connecting member and the second connecting member have threads.

* * * * *